US012295451B2

(12) United States Patent
Fuerst

(10) Patent No.: US 12,295,451 B2
(45) Date of Patent: May 13, 2025

(54) ARTICLE OF FOOTWEAR WITH HEEL CUSHION

(71) Applicant: Fuerst Group, Inc., Menlo Park, CA (US)

(72) Inventor: Rory W. Fuerst, Atherton, CA (US)

(73) Assignee: FUERST GROUP, INC., Menlo Park, CA (US)

( * ) Notice: Subject to any disclaimer, the term of this patent is extended or adjusted under 35 U.S.C. 154(b) by 90 days.

(21) Appl. No.: 17/450,973

(22) Filed: Oct. 14, 2021

(65) Prior Publication Data

US 2022/0132982 A1 May 5, 2022

Related U.S. Application Data

(60) Provisional application No. 63/110,297, filed on Nov. 5, 2020.

(51) Int. Cl.
*A43B 13/20* (2006.01)
*A43B 13/04* (2006.01)

(52) U.S. Cl.
CPC ..... *A43B 13/20* (2013.01); *A43B 13/04* (2013.01)

(58) Field of Classification Search
CPC ... A43B 13/125; A43B 13/187; A43B 13/188; A43B 13/20; A43B 13/28; A43B 13/37; A43B 13/41; A43B 21/12; A43B 21/26; A43B 21/32; A43B 21/47; A43B 23/08; A43B 23/088; A43B 23/22; A43B 23/222
USPC ..... 36/28, 34 R, 35 R, 76 R
See application file for complete search history.

(56) References Cited

U.S. PATENT DOCUMENTS 2,441,891 A * 5/1948 Lucey ..... A43B 7/22 36/166
3,538,628 A * 11/1970 Arthur, Jr. ..... A43B 3/0078 36/15
4,319,412 A * 3/1982 Muller ..... A43B 23/20 36/32 R
4,404,757 A * 9/1983 Sweeny ..... A43B 23/22 36/108
4,420,894 A * 12/1983 Glassman ..... A43B 13/36 36/12
4,922,631 A * 5/1990 Anderie ..... A43B 13/16 36/76 R
5,134,791 A * 8/1992 Gregory ..... A43B 13/42 36/76 R
5,353,526 A * 10/1994 Foley ..... A43B 23/16 36/35 R
6,519,874 B1 2/2003 Dean
6,598,320 B2 7/2003 Turner et al.
6,751,891 B2 6/2004 Lombardino
6,754,982 B2 6/2004 Reed et al.
7,213,354 B1 5/2007 Byrd et al.
7,461,470 B2 12/2008 Dardinski et al.
7,565,754 B1 7/2009 Acheson et al.
(Continued)

*Primary Examiner* — Jameson D Collier
*Assistant Examiner* — Matthew R Marchewka
(74) *Attorney, Agent, or Firm* — McCoy Russell LLP

(57) ABSTRACT

An article of footwear is provided. The article of footwear includes a sole with a heel cushion mechanically engaged with a first end of a shank at an interface that includes one or more connectors in the shank that are snap-fitted with corresponding holes in the cushion. The sole further includes a midsole body at least partially surrounding the heel cushion and the shank and the midsole body has a greater hardness than the heel cushion.

16 Claims, 6 Drawing Sheets

(56) References Cited

U.S. PATENT DOCUMENTS

| | | | | |
|---|---|---|---|---|
| 7,841,108 | B2 | 11/2010 | Johnson et al. | |
| 7,987,618 | B2 | 8/2011 | Nishiwaki et al. | |
| 8,011,119 | B2 | 9/2011 | Tvoua et al. | |
| 8,056,261 | B2 | 11/2011 | Nakano et al. | |
| 8,127,468 | B2 | 3/2012 | Morgan | |
| 8,171,655 | B2 | 5/2012 | Morgan | |
| 8,316,560 | B2 | 11/2012 | Caron et al. | |
| 8,381,418 | B2 | 2/2013 | Peyton | |
| 8,713,818 | B2 | 5/2014 | Doerer et al. | |
| 9,486,036 | B1 * | 11/2016 | Douglas | A43B 23/0245 |
| 10,165,821 | B2 | 1/2019 | Truelsen | |
| 2007/0209234 | A1 * | 9/2007 | Chou | A43B 11/00 36/138 |
| 2007/0251122 | A1 * | 11/2007 | Snow | A43B 23/22 36/29 |
| 2009/0293315 | A1 * | 12/2009 | Auger | A43B 5/02 36/114 |
| 2012/0180343 | A1 * | 7/2012 | Auger | A43B 13/26 12/146 B |
| 2013/0061495 | A1 * | 3/2013 | Lubart | A43B 13/20 36/103 |
| 2014/0250728 | A1 | 9/2014 | Devoe et al. | |
| 2017/0172251 | A1 * | 6/2017 | Douglas | A43B 9/00 |
| 2017/0202303 | A1 * | 7/2017 | Shepherd | B29D 35/08 |
| 2019/0125032 | A1 * | 5/2019 | Liu | A43B 7/1445 |
| 2020/0077741 | A1 | 3/2020 | Hurd et al. | |
| 2022/0125158 | A1 * | 4/2022 | Ni | A43B 13/127 |

* cited by examiner

ARTICLE OF FOOTWEAR WITH HEEL CUSHION

CROSS REFERENCE TO RELATED APPLICATION

The present application claims priority to U.S. Provisional Application No. 63/110,297, entitled "ARTICLE OF FOOTWEAR WITH HEEL CUSHION", and filed on Nov. 5, 2020. The entire contents of the above-listed application are hereby incorporated by reference for all purposes.

BACKGROUND

Summary

Certain shoe soles have endeavored to cushion a wearer's foot for stress reduction on the wearer's body. To that end, some types of shoes, such as running and other athletic shoes, have incorporated pressurized gas pouches into the soles. The gas pouches cushion the wearer's foot and may reduce the shoe's weight when compared to shoes using resilient polymers in the sole.

Prior sole cushioning elements, such as air bladders, may under some circumstances, be susceptible to degradation such as puncture or rupture. When the air sole is punctured, the sole's cushioning performance deteriorates. In some shoe designs, the air bladder is particularly susceptible to puncture due to the exposure of lateral sides of the air bladder to the surrounding environment. Further, prior air cushioned soles may expand cushioning performance at the expense of sole stability. Sole instability issues may be particularly noticeable in shoes intended for off-road use, such as hiking and trail running shoes that may encounter rocks, gravel, roots, all of varying size that create wide variations in underfoot terrain profile. As such, some trail running and hiking shoes have forgone air cushioning elements to avoid instability issues that may arise when the shoe is used in its intended environment. However, the gains in sole stability may come at the expense of degraded sole cushioning performance and increased weight, in some cases. As such, some sole designs have made unwanted tradeoffs between cushioning and stability.

In one embodiment, an article of footwear is provided to resolve at least a portion of the abovementioned challenges. In such an embodiment, the article of footwear includes a sole with a heel cushion that is mechanically engaged with a first end of a shank at an interface. The interface between the shank and the heel cushion includes one or more connectors in the shank that are snap-fitted with corresponding openings in the heel cushion. The sole further includes a midsole body that at least partially surrounds the heel cushion and the shank and has a greater hardness than the heel cushion. In this way, the heel's cushioning performance is increased using a heel cushion that is mechanically attached to and supported by a shank. The article of footwear may therefore achieve a desired balance between heel compliance and foot support via the cushion and shank assembly.

Further, in one example, the connectors may be designed to mechanically snap into the openings in the heel cushion and the midsole body may be directly coupled to the shank and the heel cushion. In this way, the sole may be efficiently constructed and exhibit a robust construction that is less susceptible to degradation.

BRIEF DESCRIPTION OF THE FIGURES

The present disclosure will be better understood from reading the following description of non-limiting embodiments, with reference to the attached drawings, wherein below:

FIGS. 1-10 are drawn approximately to scale. However other relative dimensions may be used, in other embodiments.

DETAILED DESCRIPTION

The following description relates to various embodiments of an article of footwear including a midsole with a heel cushion that is mechanically attached to a shank. In certain examples, a midsole body surrounds and is directly attached to the heel cushion and the shank, without the use of glues or solvents. In this way, the midsole assembly may be strengthened and the assembly's manufacturing efficiency may be increased. The mechanical interface between the heel cushion and the shank is formed via connectors in the shank that securely snaps into holes in the heel cushion. By forming the mechanical attachment in this manner, the connection between the heel cushion and the shank may be strengthened. Further, gains in manufacturing efficiency may be realized through the use of the connector and opening interface, if so desired.

A set of reference axes 101 are provided for comparison between views shown, indicating a y-axis, a z-axis, and an x-axis. In some examples, the z-axis may be parallel with a direction of gravity, with the x-axis and y-axis defining a horizontal plane. Thus, the x-axis may denote lateral directions and the y-axis may denote longitudinal directions. However, the axes may have other orientations, in other embodiments.

Figure 2:
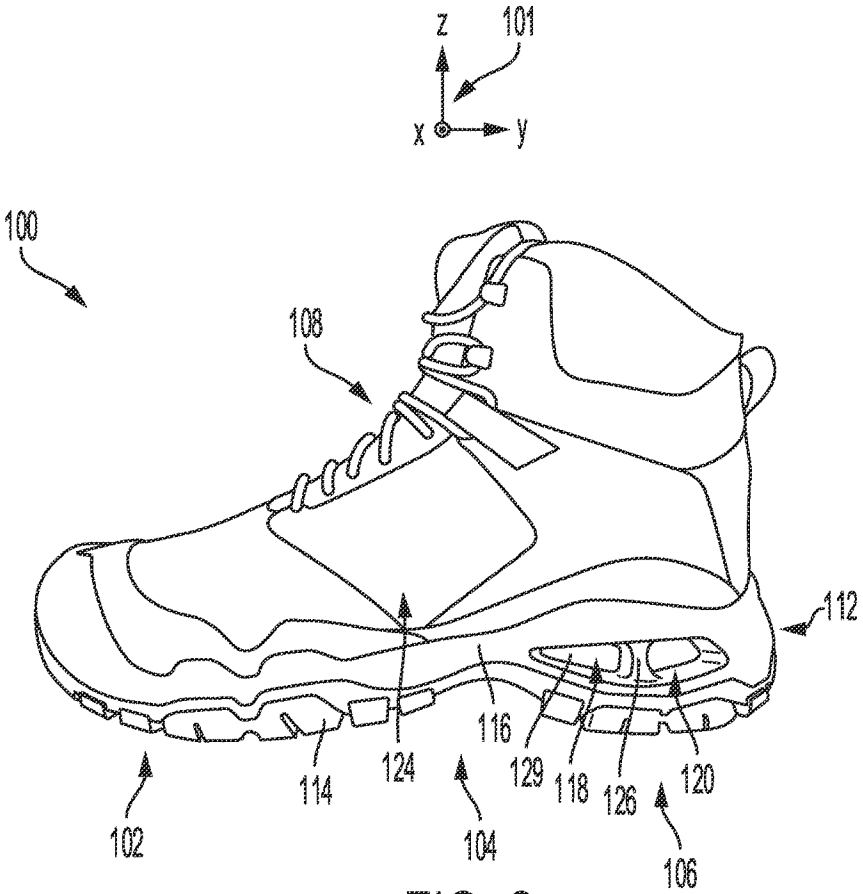
FIG. 2 is a medial side elevation view of the article of footwear, depicted in FIG. 1.
Figure 1:
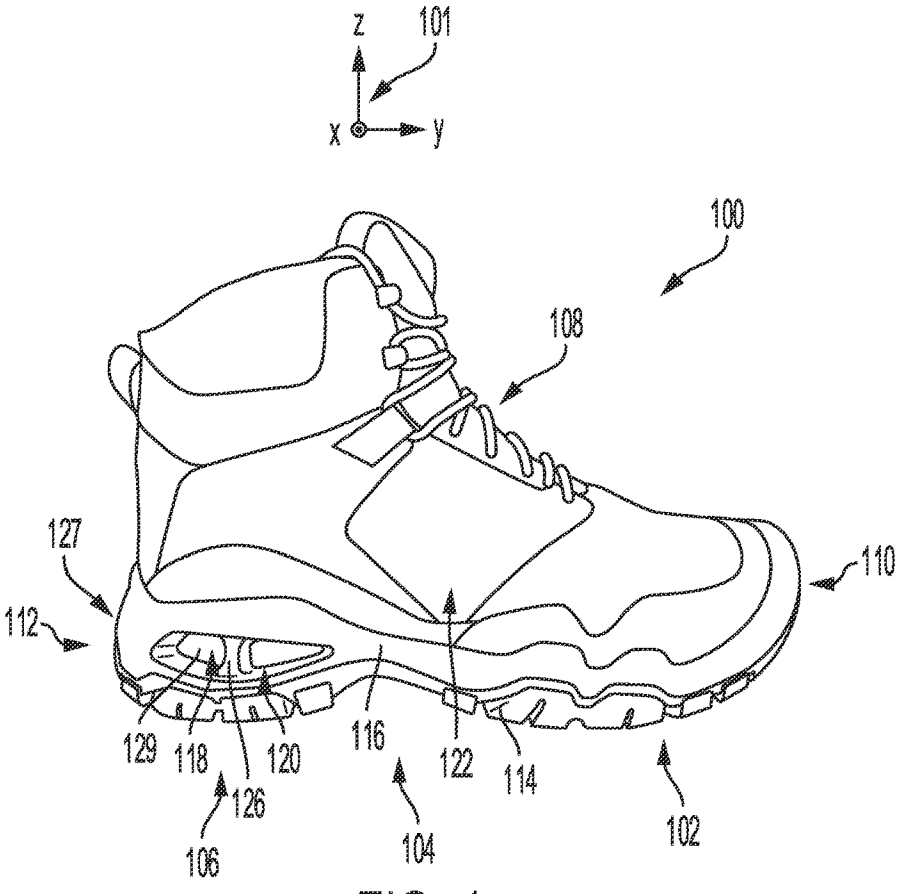
FIG. 1 is a lateral side elevation view of an article of footwear according to an embodiment.

Turning now to FIGS. 1 and 2 that depict an article of footwear 100 in lateral and medial side views, opposite one another, according to an embodiment. The article of footwear 100 may generally include: a forefoot region 102, which generally includes portions of the article of footwear 100 that correspond with the toes and the joints connecting the metatarsals with the phalanges; a midfoot region 104, which generally includes portions of the article of footwear that correspond with the arch area of the foot; and a heel region 106 that corresponds with rear portions of the foot. Regions 102, 104, and 106 are not intended to demarcate precise areas of the article of footwear 100, rather regions 102, 104, and 106 are intended to represent general areas of the article of footwear 100 to aid in the following discussion.

The article of footwear 100 further includes an upper 108 and a sole 110 with a midsole 112 and an outsole 114. The upper 108 may include lacing, hook and loop materials, eyelets, and the like to secure the shoe to the user's foot. The outsole 114 may include a patterned material designed to encounter underfoot terrain.

The midsole 112 includes a midsole body 116 at least partially formed around a heel cushion 118. Specifically, in one exemplary embodiment, the midsole body 116 may be directly coupled to the heel cushion 118. The direct attachment between the midsole body and the heel cushion decreases the likelihood of separation of the midsole body from the heel cushion and more generally increases the strength of the midsole assembly. The direct midsole body and cushion attachment may additionally increase manufacturing efficiency. The heel cushion 118 is arranged in the heel region 106 and pads and otherwise provides a compliant material which increases comfort and reduces stress on the wearer. Additionally or alternatively, a cushion, similar to the cushion 118 may be provided in the forefoot of the article of footwear 100.

In the illustrated example, the midsole body 116 includes openings 120 on both the lateral side 122 and the medial side 124 of the article of footwear 100. Although, footwear arrangements with an opening on one of the medial and lateral sides have been contemplated. The openings 120 may decrease the weight of the article of footwear without unduly impacting the desired flexion of the midsole and outsole.

Further, each of the openings 120 may be divided into two sections partitioned by a support extension 126. As shown, the sections of the openings may have a similar depth that is bounded by a side surface 129 of the cushion 118. However, in other examples, the openings may include a different number of sections (e.g., a greater or fewer number of sections) and/or the sections may have varying depths. In other examples, some of the sections may be arranged in the rear side 127 of the midsole. Further, in some examples, the depth, width, and/or height of the openings 120 may, in some examples, vary from opening to opening and/or section to section. For instance, an opening on the rear side of the midsole may have a smaller depth than the windows on the lateral sides of the midsole. The variance in opening profile may enable the support and flexion characteristics of the sole to be tuned to suit end-use design goals. Additionally or alternatively, the midsole body 116 may include openings on the rear side of the heel section and/or openings in the forefoot or midfoot region. In this way, the sole's weight may be further reduced and the sole may offer cushioning under foot (in addition to under heel).

Further in an alternate example, the cushion 118 may be divided into distinct sections and one or more of the midsole openings may extend laterally inward into a gap between the cushion sections. The size and positioning of the cushion sections and midsole openings may be chosen to achieve support and flexion characteristics tailored to the footwear's intended operating environment.

Material construction of the heel cushion 118 and the midsole body 116 may vary to allow footwear cushioning to be increased in areas of the article of footwear expected to experience larger impacts. For instance, the heel cushion 118 may be constructed out of an air injected polyurethane (PU) foam while the midsole body 116 may be constructed out a denser PU material. Thus, the cushion may exhibit greater compliance than the midsole which may be achieved using a variance in material construction. When the cushion 118 is formed from PU, it is less susceptible to degradation from environmental objects such as rocks, gravel, sticks, and the like that may strike the cushion through the opening 120 when compared to footwear with gas filled bladders. Further, in some examples, the heel cushion 118 may be constructed out of multiple materials having different densities. For instance, the heel cushion may include a lower section that is denser than an upper section. In this way, the cushioning characteristics of the cushion may be fine-tuned to achieve cushioning performance targets.

In certain constructions, the heel cushion 118 and the midsole body 116 may be coupled or partially coupled via a chemical bond there between. In this way, a strong attachment may be formed between these footwear constituents. However, other suitable attachment techniques between the heel cushion and the midsole body have been envisioned, such as mechanical attachment using stitching, snaps, pins, etc.

The midsole body 116 may correspondingly have a greater hardness than the heel cushion. In one specific example, the variance in hardness between the midsole body and the heel cushion may be equal to or greater than 5 units on the shore hardness scale. Constructing the midsole and cushion with this amount of variance allows the article of footwear to strike a desired balance between cushioning and support, thereby enhancing the user's comfort.

The midsole body 116 may extend from the heel region 106 to the forefoot region 102. However, alternate constructions with variations in the midsole's profile have been envisioned. The profile and other structural characteristics of the midsole body may be selected based on the footwear's intended use environment, material properties of the outsole, and the profile of the upper, for instance.

Further, as illustrated, the support extension 126 may span (e.g., vertically span) the openings 120. The support extension 126 reinforces the midsole body opening to reduce the chance of unwanted sole deformation. The support extension 126 may form a continuous structure with the remainder of the midsole and be constructed out of a similar material. However, in alternate embodiments, the support extension may be formed from a stiffer material than other sections of the midsole body. Further, in some examples, the midsole may include additional support extensions that bridge the openings or the support extensions may be omitted from the midsole, in other examples.

Figure 3:
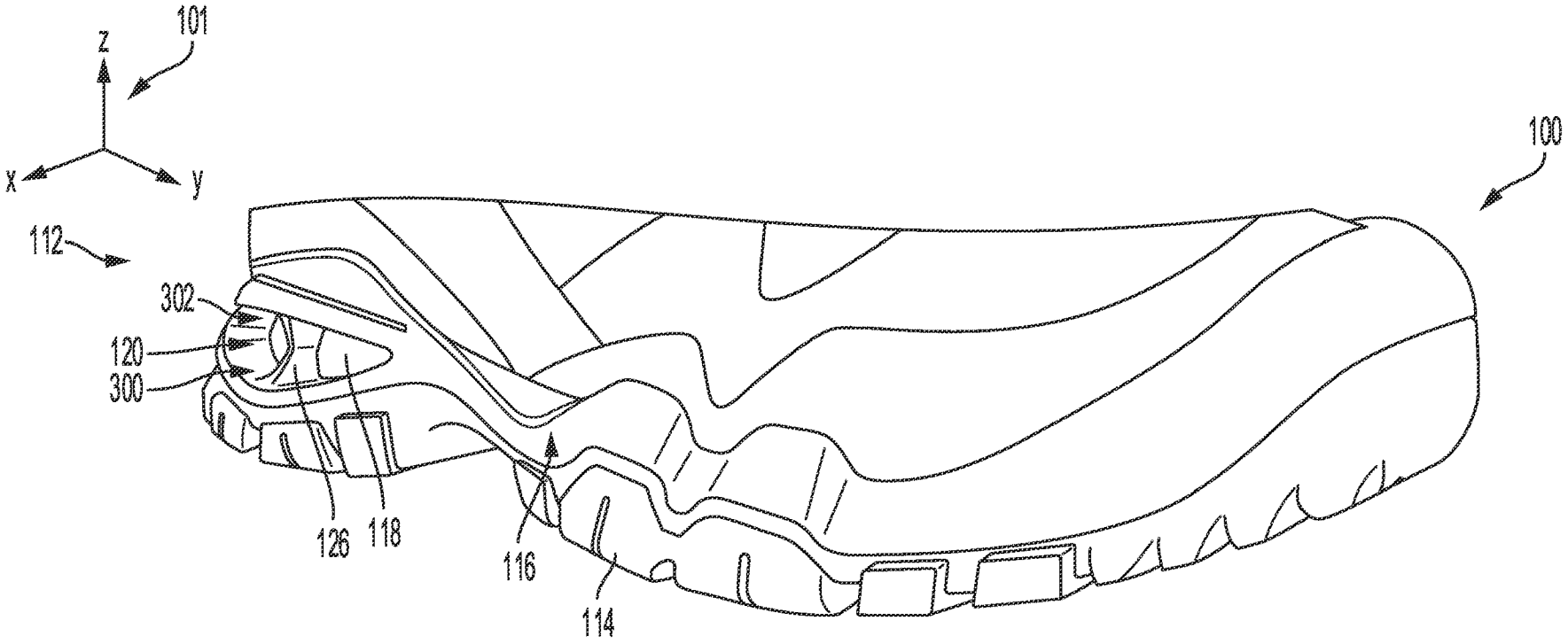
FIG. 3 is an enlarged view of the midsole of the article of footwear, depicted in FIG. 1.

FIG. 3 shows a detailed view of the midsole 112 in the article of footwear 100. The midsole body 116 with the support extension 126 that bridges the opening 120 is again illustrated. Further, the heel cushion 118 is shown incorporated into the midsole body 116. The support extension 126 may specifically include an upper and lower section that each taper in a direction towards the center of the extension. In some instances, the opening 120 may include a lower side 300 curved towards the outsole 114 and an upper side 302 that may be approximately planar. The midsole body 116 is further shown extending around a toe box, but other body contours that terminate prior to the toe region, may be used.

Figure 4A:
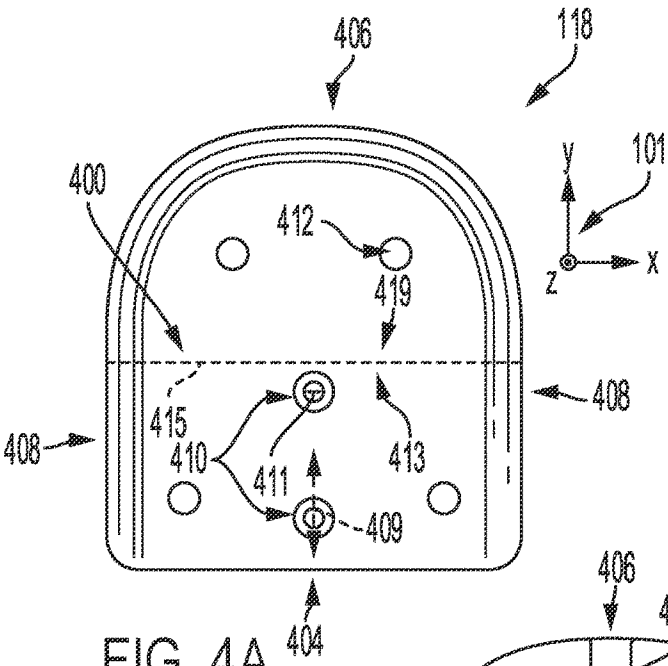
FIGS. 4A and 4B are plan views of a top and a bottom of a heel cushion in the midsole of the article of footwear, depicted in FIG. 1.
Figure 4B:
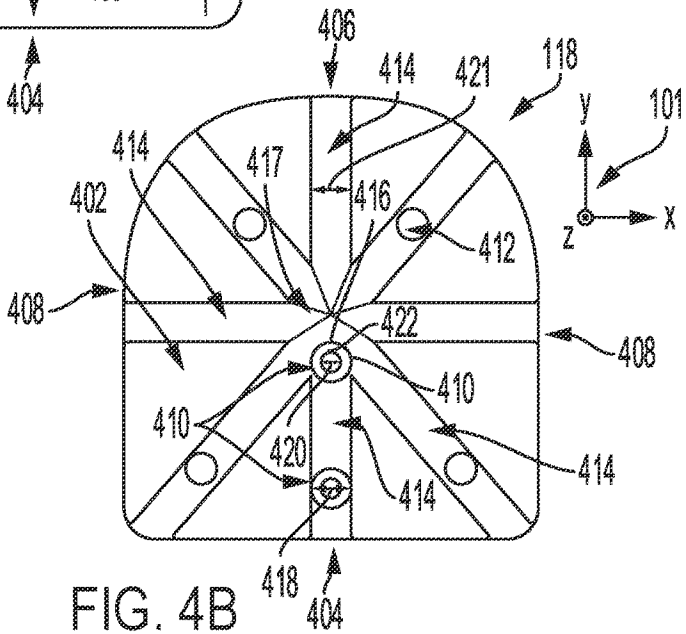

FIGS. 4A and 4B depict upper and lower sides 400, 402 of the heel cushion 118. The cushion may generally conform to the heel section of the footwear and specifically may include a planar front side 404 and a curved rear side 406, although other cushion contours are possible. Further, as illustrated the lateral sides 408 of the heel cushion 118 may be planar. However, the cushion's lateral sides may be profiled with curvature (e.g., convex or concave curvature), in other embodiments.

The heel cushion 118 includes holes 410 designed to mate with connectors (e.g., domed connectors) in a shank, discussed in greater detail herein. The holes 410 may be aligned with a longitudinal axis 409 of the cushion to allow the shank to provide symmetric lateral support to the cushion. The heel cushion 118 may further include additional openings 412 which may receive midsole body material during the sole manufacturing process. These openings may be positioned on both the front and rear sections of the cushion. The openings 412 may be sized such that the connectors in the shank snap into the heel cushion 118. In this way, the shank and heel cushion may be efficiently assembled, if wanted.

Recesses 414, on the lower side of the cushion 118, may extend across the heel cushion 118. In some examples, the recesses may have substantially constant widths 421 along their length or may have variable widths, in other examples. The width and other contours of the recesses may be selected based on desired cushioning performance targets, cushion flexion targets, cushion material construction, and the like. The recesses 414 may specifically extend across the holes 410 and the openings 412. To elaborate, one of the recesses may extend laterally across the heel cushion, one of the recesses may extend longitudinally across the heel cushion, and a pair of the extensions may diagonally extend across the cushion. The recesses 414 may intersect at a central region 417 forming a symmetric arrangement which allows for desired cushion articulation. However, in alternate examples, at least a portion of the recesses may not intersect or asymmetrically intersect. However, in alternate examples, the recesses may be omitted from the cushion.

The holes 410 are further shown positioned closer to the cushion's front side 404 than the rear side 406 which may allow the cushion to achieve a desired amount of compliance near the rear side. To elaborate, holes 410 in the cushion 118 may be arranged on a front section 413 demarcated via a midline 415. In this way, the shank may provide a targeted amount of support to a selected portion of the cushion while allowing the rear side of the cushion to be more compliant. The user's comfort may be consequently increased. However, the holes may be positioned on both the front and rear sides of the midline, in alternate examples. Further, the openings 412 may be arranged on both the front section 413 and a rear section 419 divided by the midline 415.

The holes 410 may have a stepped contour with a first section 416 with a greater diameter 418 than a diameter 420 of a second section 422. The stepped contour allows the heads of the connectors (e.g., domed connectors) to be recessed in the cushion when attached and may enable the connectors in the shank to be efficiently coupled to (e.g., snap-fit into) the cushion. In alternate embodiments, holes which continuously taper in diameter from one end to the other or have a substantially continuous diameter may be used. Further, the connectors may be annular snap-fit connectors, torsional snap-fit connectors, and/or cantilever snap-fit connectors.

Figure 5B:
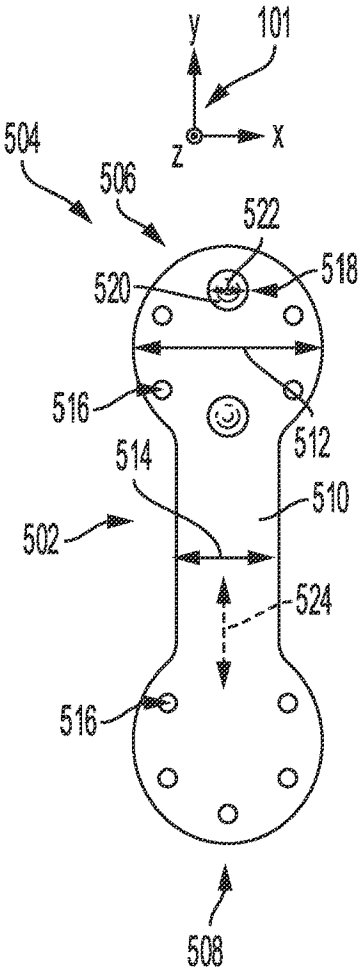
FIGS. 5A and 5B are plan views of a top and a bottom of a shank in the midsole of the article of footwear, depicted in FIG. 1.
Figure 5A:
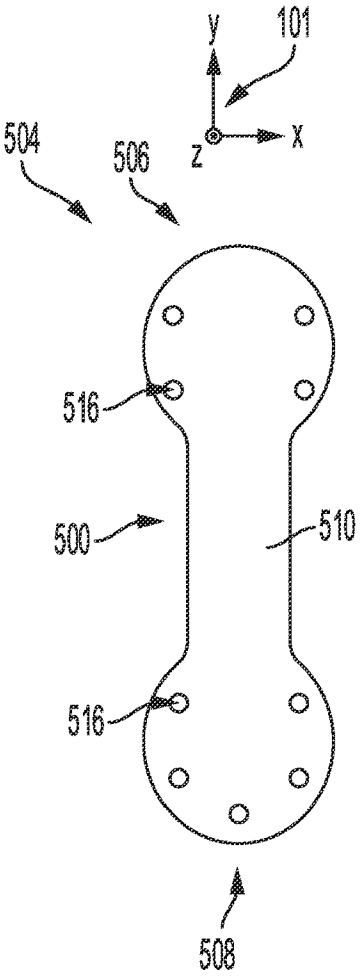

FIGS. 5A and 5B depict upper and lower sides 500, 502 of a shank 504. The shank 504 exhibits a dog-bone profile, in the illustrated example. The shank 504 includes opposing ends 506, 508 connected via an intermediate section 510. Further, in the illustrated example, the opposing ends 506, 508 flare out and therefore have a greater width 512 than the width 514 of the intermediate section 510. This flared contour may enable the strength of the connection between the shank and the heel cushion to be increased and may further enable the intermediate section 510 to achieve a desired amount of compliance. For instance, it may be desirable to allow the shank to exhibit a targeted amount of flexion during footwear use. Even further, the width 514 of the intermediate section 510 is substantially constant along the length of the section, in the illustrated example. Alternatively, the intermediate section may have lateral edges that curve inward or outward to allow the shank to achieve greater flexion, in articles of footwear where greater sole flexion is favored. In another alternate example, the shank may have a continuous width along its length.

The shank 504 may further include holes 516 in each of the ends 506, 508. The holes may be designed to receive midsole material during sole manufacturing. Alternatively, the holes may be included in only one of the two ends of the shank. In the illustrated example, the ends 506, 508 are rounded to provide a desired amount of support to the cushion and the midsole body. However, shank ends with one or more straight sides have been contemplated.

The shank 504 further includes connectors 518 at the end 506. The connectors 518 enable the shank to be efficiently attached to the heel cushion 118, shown in FIG. 4B, during manufacturing. The connectors are specifically illustrated as annular connectors with heads formed as domes. Thus, in some examples, the connectors may be domed connectors. However, other types of snap-fit connectors may be used in other examples, such as torsional connectors and/or cantilever connectors. The connectors 518 may include heads 520 that may have a greater diameter 522 than at least the smaller diameter 411 of the holes 410 in the heel cushion 118, shown in FIG. 4B. In this way, the shank may be securely and releasably attached to the heel cushion. In other words, the connectors may snap-fit into the holes in the heel cushion. The connectors 518 may further include shafts 700, shown in FIG. 7A, connected to the heads 520 and described in greater detail herein. Thus, in one example, the connectors may be formed as domed pegs. The domed connectors may further be aligned with a longitudinal axis 524 of the shank 504. Further, in the illustrated example, the heads 520 of the connectors 518 have a curved contour. However, in other examples, the heads may have edges and/or planar surfaces.

Figure 6B:
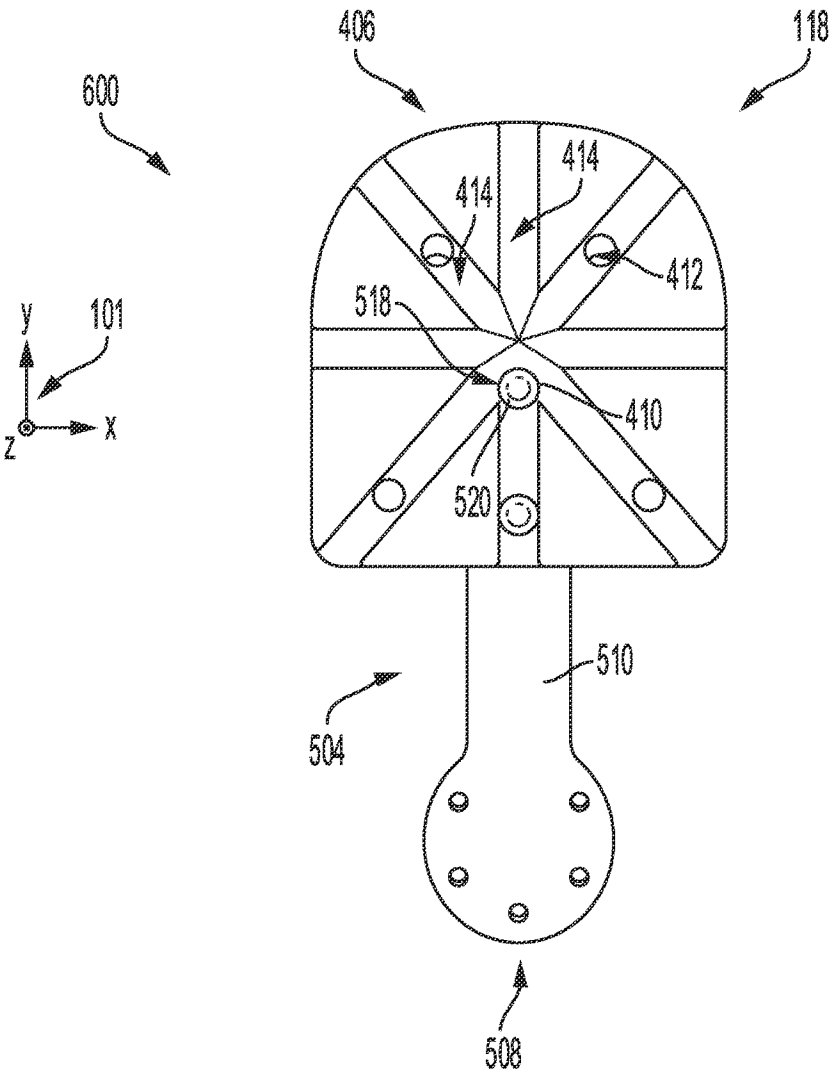
FIGS. 6A and 6B are plan views of a top and a bottom of an assembly of the heel cushion and the shank, depicted in FIGS. 4A-5B.
Figure 6A:
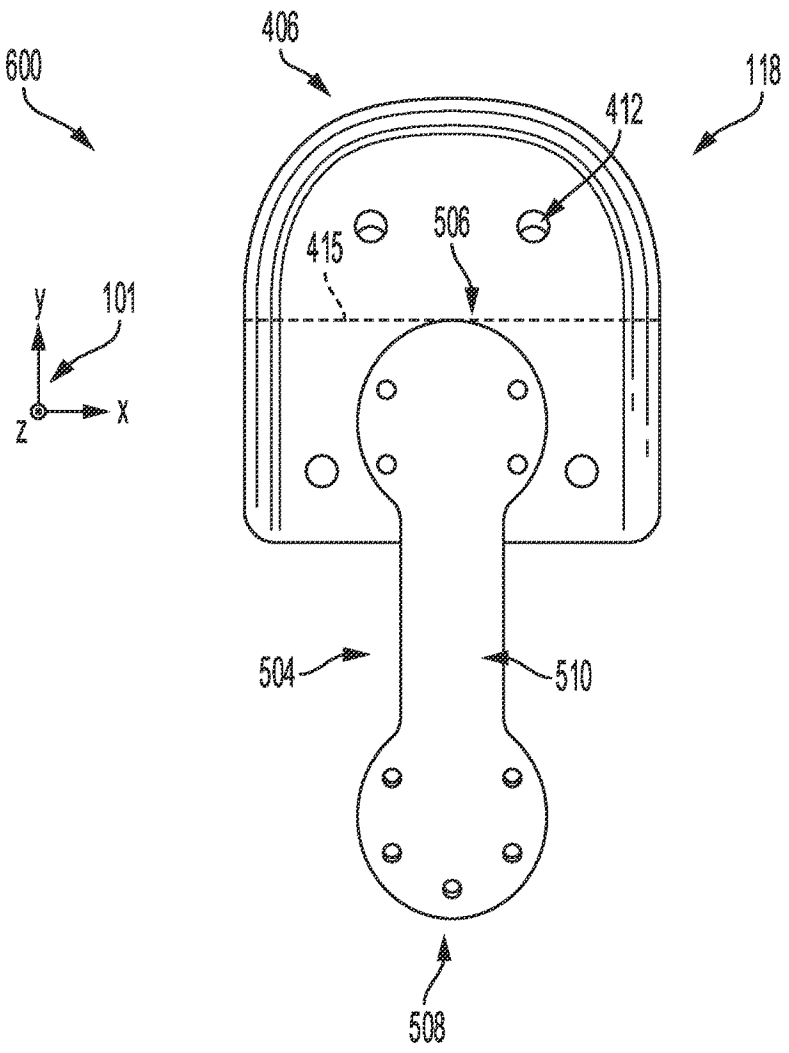

FIGS. 6A and 6B depict opposing sides (upper and lower sides) of an assembly 600 formed between the heel cushion 118 and the shank 504. FIG. 6A specifically illustrates the end 506 of the shank 504 in mechanical engagement with the heel cushion 118. The rear side 406 of the heel cushion 118 may be offset from the end 506 of the shank. To elaborate, the end 506 of the shank may be positioned in front of the midline 415, in certain examples, to enable the cushion-shank assembly to strike a desired balance between cushion support and compliance. However, in other examples, the end 506 of the shanks may extend rearward of the midline 415.

FIG. 6B correspondingly shows the connectors 518 protruding through the holes 410 in the cushion 118. To elaborate, heads 520 of the connectors 518 may have a greater diameter than the shaft 700 of the connectors 518, shown in FIG. 7A. Continuing with FIGS. 6A and 6B, as previous indicated, the heads 520 may have a greater diameter 522 than a diameter of the holes 410 (e.g., a smaller diameter of the holes, in the stepped configuration) in the heel cushion. In this way, a snap fit which securely connects the cushion to the shank may be achieved. In some instances, during sole manufacturing, the cushion may be mechanically attached to the shank via this snap fit technique, and the assembly may then be placed in a mold where midsole body material, such as PU, is shot around the shank-cushion assembly. However, alternative suitable sole construction techniques have been contemplated.

FIGS. 6A and 6B again show the end 508 and the intermediate section 510 of the shank 504 along with the openings 412 in the cushion 118. The end 508 may terminate in the midfoot region 104, illustrated in FIGS. 1 and 2, in one example. In this way, the user's heel and midfoot may be supported as desired. When the footwear sole is formed, midsole body material, such as PU, may be formed around the cushion and the shank without any intervening material there between, enabling a secure and robust connection to be established between the midsole components.

The recesses 414 are again shown in FIG. 6B. One of the recesses 414 may be longitudinally aligned with the connectors 518. The depth of the recesses may be substantially constant along their lengths, in one example, or vary along their lengths, in other examples, to granularly tailor cushion flexion.

Figure 7A:
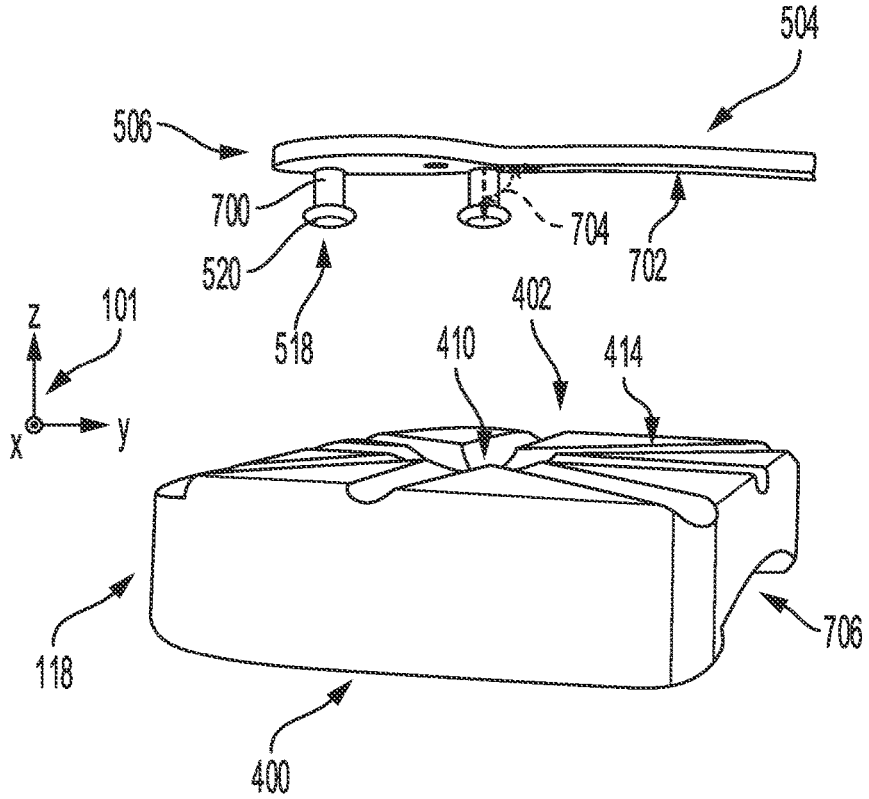
FIG. 7A is a disassembled view of the heel cushion and shank assembly, depicted in FIGS. 6A-6B.

FIG. 7A shows a disassembled view of the heel cushion 118 and the shank 504. The connectors 518 of the shank 504 may be brought into mechanical engagement with heel cushion holes 410. As previously discussed, the holes may extend through the cushion from the lower side 402 to the upper side 400. When connecting the cushion and shank, the shank may be mechanically engage the upper side 400 of the cushion opposite to the lower side 402 that includes the recesses 414. The shafts 700 and the heads 520 of the connectors 518 are further illustrated in FIG. 7A. The connectors 518 may have a substantially vertical alignment and may be approximately perpendicularly aligned with regard to a base 702 of the shank. The angle between the shank's base and the connectors is indicated at 704. To elaborate, each of the connectors may form a similar angle with the base of the shank to increase the efficiency of mechanical attachment between the shank and the cushion. However, in alternate examples, the connectors may be arranged at an acute or obtuse angle with regard to the shank's base or the angles may vary between the connectors.

FIG. 7A further illustrates a depression 706 in the upper side 400 of the cushion 118. The depression 706 may curve inward toward the opposing side of the cushion and is shaped to receive the end 506 of the shank 504. Thus, when the shank 504 is attached to the cushion 118, at least a portion of the end 506 may reside in the depression 706. Alternatively, the upper side of the cushion may have a substantially planar surface.

Figure 7B:
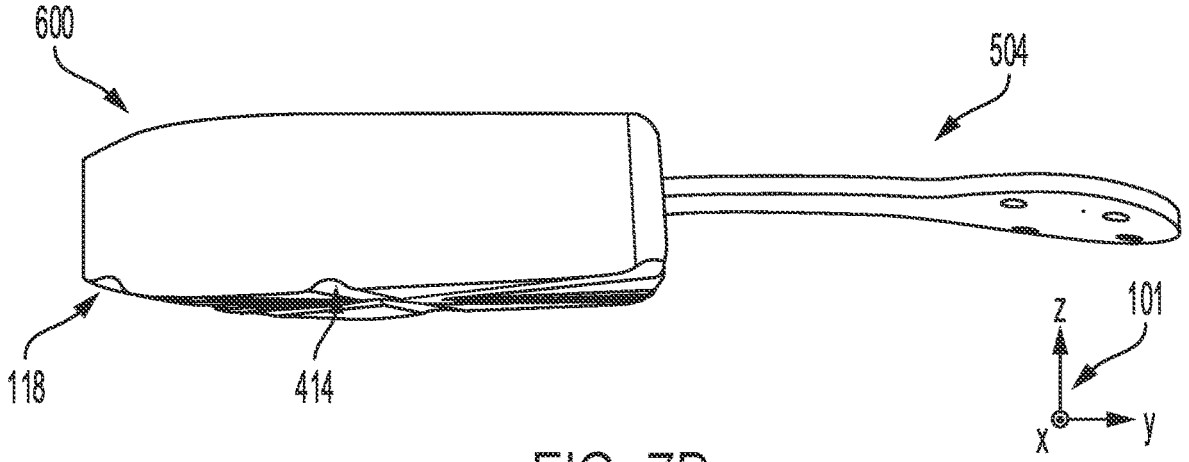
FIG. 7B is an assembled elevation view of the heel cushion and shank assembly, depicted in FIG. 7A.

FIG. 7B depicts the assembly 600 of the shank 504 and the heel cushion 118, where the connectors 518, shown in FIG. 7A, mechanically engage and mate with the cushion holes 410, illustrated in FIG. 7A. In particular, the mechanical engagement may be formed via the heads of the connectors snapping into the holes. As the engagement unfolds, the holes may temporarily expand and then contract once the heads have passed therethrough. The recesses 414 in the heel cushion 118 are again depicted in FIG. 7B.

Figure 8:
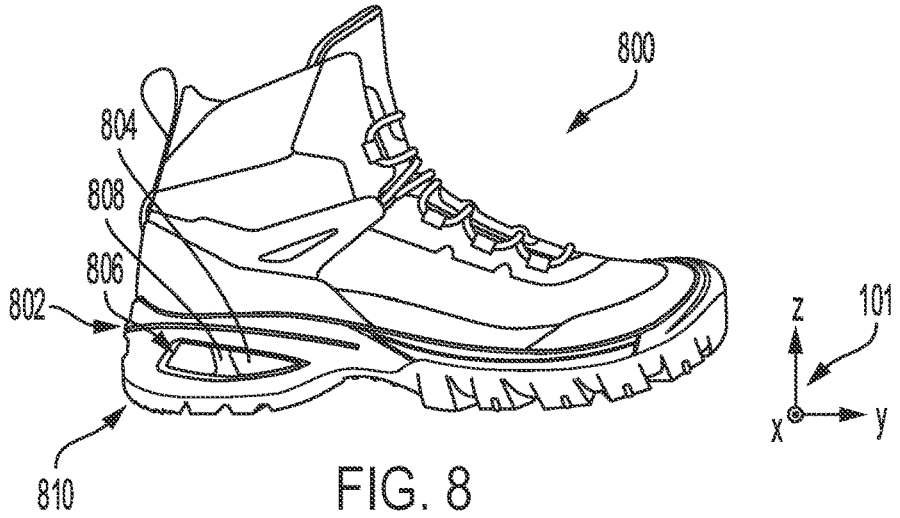
FIG. 8 is a second embodiment of an article of footwear.

FIG. 8 shows a second embodiment of an article of footwear 800 that includes a sole assembly with a midsole body 802 that at least partially surrounds a heel cushion 804. The form factor of the second embodiment varies from the footwear embodiment 100 depicted in FIGS. 1-2, though the footwear embodiments share common structural and functional characteristics. It will further be appreciated that the heel cushion and shank assemblies described herein may be integrated into a variety of footwear types such as running footwear, casual footwear, sandal footwear, occupational footwear, and the like. The size and profile of the heel cushion 804 may be augmented to suit the footwear's end-use design goals.

The midsole body 802 again includes an opening 806 with a support extension 808 bridging said opening. However, the support extension 808 extends rearward toward a heel region 810, although other support extension profiles have been envisioned. For instance, the contour of the support extension may be determined based on expected loading of the extension, desired heel cushion compliance, the material construction of the sole assembly, and the like.

Figure 9:
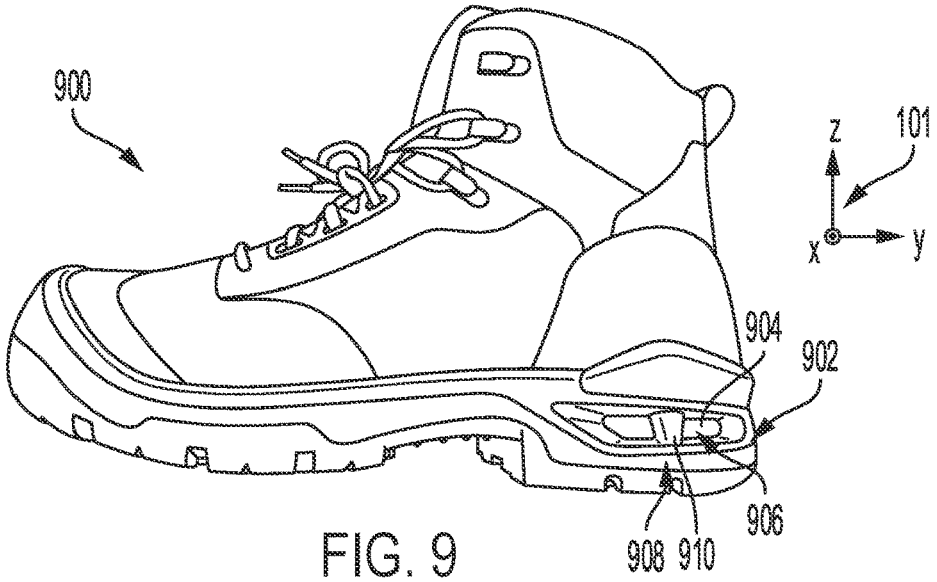
FIG. 9 is a third embodiment of an article of footwear.

FIG. 9 depicts another embodiment of an article of footwear 900 that includes a midsole 902 with a cushion 904 in an opening 906 in a midsole body 908. Again, a support extension 910 may extend (e.g., vertically extend) across the opening 906 and increase the structural integrity of the sole assembly. The article of footwear 900 may be designed for occupational tasks, although other end-use operating environments are possible. Thus, in one example, the cushion 904 may be thicker than the previously described article of footwear, to reduce stress on the wearer's foot. However, numerous cushion profiles are possible.

Figure 10:
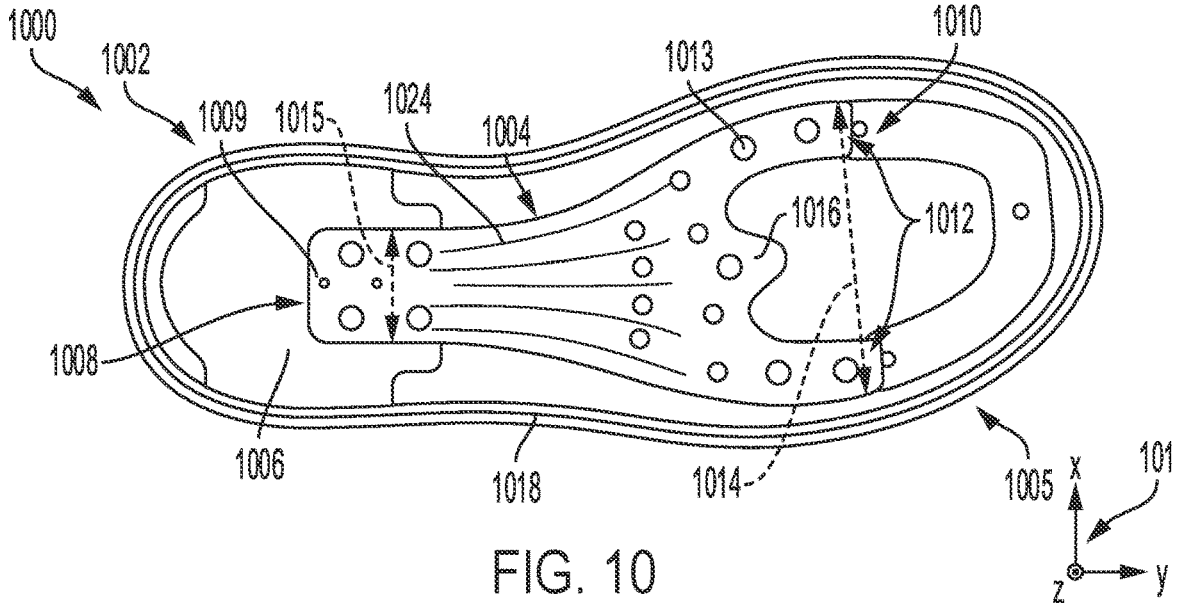
FIG. 10 is another embodiment of a shank in an article of footwear.

FIG. 10 illustrates yet another embodiment of an article of footwear 1000 with a sole 1002 having a shank 1004, a midsole 1005, and a heel cushion 1006. A rear end 1008 of the shank is again attached to the heel cushion 1006. Pins 1009 may serve as an attachment interface between the heel cushion 1006 and the shank 1004, although additional or alternative attachment schemes have been contemplated such as the previously described connectors (e.g., domed connectors) and/or adhesive attachment, in some cases. Again, the heel cushion 1006 may be constructed out of a material such as PU that has less density than the material used to construct the midsole 1005. However, a front end 1010 of the shank 1004 includes protrusions 1012 (e.g., tangs) in the shape of a fork. It will be understood, that the protrusions may be at least partially surrounded by the midsole body material. In this way, the protrusions 1012 may permit the shank to be more securely connected to the midsole body while also allowing the sole to achieve a desired amount of flexion, when compared to shanks with front ends that include a continuous piece of material laterally spanning the shank.

The protrusions 1012 may include openings 1013 designed to allow PU or other suitable polymer in the midsole 1005 to flow therethrough. The PU flow through the hole facilitates strong and durable attachment between the midsole 1005 and the shank 1004. Further, the protrusions 1012 may have a greater width 1014 than a width 1015 of the rear side of the shank to enhance midfoot support. The shank 1004 may further include a central extension 1016, to further enhance support. The shank 1004 may further include undulating ribbing 1024 that increases the shank's structural integrity (e.g., torsional rigidity). In one specific use-case embodiment the shank may be constructed out of a thermoplastic polyurethane (TPU) that may be 2.0 millimeters (mm) thick, as measured along the z-axis, and have 70 hardness on the shore A hardness scale. Further, a PU bead 1018 in the midsole 1005 may traverse the periphery of the midsole.

The non-limiting embodiments of the articles of footwear has been described and illustrated herein. It should be appreciated that one or more components, features, or parts of the articles of footwear 100, 800, 900, 1000 may have a different shape, size, orientation, material, or other characteristic than those specifically explained or illustrated in accordance with the present disclosure. For example, the sole 110 may be incorporated as part of a sandal, thong flip-flops, clamp flip-flops, sporting footwear, boots, occupational footwear, e.g., work boots, or any other variation of a footwear article that includes a midsole assembly. Further, different elements of the midsole 112 may be otherwise suitably shaped and/or of different dimensions and/or orientations than described.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

FIGS. 1-10 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. Elements offset from one another may be referred to as such, in some examples.

The invention will be further described in the following paragraphs. In one aspect, an article of footwear is provided that comprises a sole comprising: a heel cushion mechanically engaged with a first end of a shank at an interface that includes one or more connectors in the shank that are snap-fitted with corresponding holes in the heel cushion; and a midsole body at least partially surrounding the heel cushion and the shank; wherein the midsole body has a greater hardness than the heel cushion.

In another aspect, a footwear sole is provided that comprises a heel cushion mechanically engaged with a first end of a shank at an interface that includes one or more vertically aligned domed pegs in the shank mated with corresponding holes in the heel cushion; and a midsole body at least partially surrounding the heel cushion and the shank; wherein the midsole body has a greater hardness than the heel cushion; and wherein the midsole body includes an opening positioned on at least one of a lateral side and a medial side of the footwear sole and extending inward to the heel cushion.

In another aspect, a footwear sole is provided that comprises a heel cushion including depression that receives a first end of a shank and mechanically engages with the first end of the shank, wherein the first end of the shank has a greater width than an intermediate section of the shank; and a midsole body at least partially surrounding the heel cushion and the shank; wherein the midsole body has a greater hardness than the heel cushion; and wherein the midsole body includes an opening positioned on at least one of a lateral side and a medial side of the footwear sole and extending inward to the heel cushion.

In yet another aspect, a footwear sole assembly is provided that comprises a heel cushion including a depression that receives a first end of a shank, wherein the first end has a greater width than an intermediate section of the shank; and a midsole body at least partially surrounding the heel cushion and the shank; wherein the shank includes a plurality of domed connectors designed to snap fit into an associated hole in the heel cushion; wherein the midsole body has a greater hardness than the heel cushion; and wherein the midsole body includes a plurality of openings positioned on a lateral side and a medial side of the footwear sole and extending inward toward the heel cushion.

In any of the aspects or combinations of the aspects, the first end of the shank may be positioned in front of a midline of the heel cushion.

In any of the aspects or combinations of the aspects, the midsole body may be directly coupled to the heel cushion.

In any of the aspects or combinations of the aspects, a difference between the hardness of the midsole body and the heel cushion may be at least five units on a shore hardness scale.

In any of the aspects or combinations of the aspects, the shank may include a second end connected to the first end via an intermediate section having a smaller width than the first and second ends.

In any of the aspects or combinations of the aspects, the first and second ends may be rounded.

In any of the aspects or combinations of the aspects, the heel cushion may be constructed out of an air injected polyurethane (PU).

In any of the aspects or combinations of the aspects, the shank may terminate in a midfoot region of the midsole body.

In any of the aspects or combinations of the aspects, the midsole body may include an opening positioned on at least one of a lateral side and a medial side of the sole and extending inward to the heel cushion.

In any of the aspects or combinations of the aspects, a support extension may bridge the opening in the midsole body.

In any of the aspects or combinations of the aspects, the shank may include a second end connected to the first end via an intermediate section having a smaller width than the first and second ends and wherein the first and second ends may be rounded.

In any of the aspects or combinations of the aspects, the one or more vertically aligned domed pegs may each include a domed connector with a head that has a greater diameter than a diameter of the associated hole in the heel cushion.

In any of the aspects or combinations of the aspects, the heel cushion may be constructed out of an air injected polyurethane (PU), the midsole body may be constructed out of a different PU than the heel cushion, and the PU midsole body may be directly coupled to the heel cushion.

In any of the aspects or combinations of the aspects, the midsole body may be directly coupled to the shank.

In any of the aspects or combinations of the aspects, a support extension may vertically extend across the opening.

In any of the aspects or combinations of the aspects, the plurality of domed connectors may be positioned in flared sections at opposing sides of the shank.

In any of the aspects or combinations of the aspects, the shank may include a plurality of tangs at a front end that are at least partially surrounded by the midsole body; and the shank may include undulating ribbing that at least partially extend along a length of the shank.

In any of the aspects or combinations of the aspects, the shank may include two flared sections that are positioned at opposing ends thereof and have a greater width than the intermediate section; and a plurality of domed pegs may extend vertically from the two flared sections.

In any of the aspects or combinations of the aspects, the shank may include a plurality of tangs at a front end that are at least partially surrounded by the midsole body.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any articles, devices, or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. An article of footwear, comprising:

a sole comprising:

a heel cushion including one or more holes that continuously extend through the heel cushion from an upper side of the heel cushion to a lower side of the heel cushion;

a shank including an intermediate section disposed longitudinally between two opposing end sections, wherein one of the two opposing end sections is positioned above the heel cushion, wherein one or more connectors extend downward from the one of the two opposing end sections, and wherein the one or more connectors are configured to snap-fit with the one or more holes in the heel cushion, thereby forming a snap-fit interface; and a midsole body at least partially surrounding the heel cushion and the shank;

wherein the snap-fit interface is positioned in front of a midline of the heel cushion;

wherein each of the two opposing end sections of the shank have a greater width than the intermediate section;

wherein the midsole body has a greater hardness than the heel cushion;

wherein the one or more connectors each include:

a shaft that extends from a base of the shank; and a head with a circular periphery that has a greater diameter than a diameter of an associated hole included in the one or more holes in the heel cushion;

wherein a portion of the intermediate section of the shank is positioned directly vertically above the heel cushion; and wherein the shank is positioned below an upper.

2. The article of footwear of claim 1, wherein the heel cushion is constructed out of an air injected polyurethane (PU).

3. The article of footwear of claim 1, wherein the shank terminates in a midfoot region of the midsole body.

4. The article of footwear of claim 1, wherein the midsole body includes an opening positioned on at least one of a lateral side and a medial side of the sole and extending inward to the heel cushion.

5. The article of footwear of claim 4, wherein a support extension bridges the opening in the midsole body.

6. A footwear sole, comprising:

a heel cushion and a shank, the shank including an intermediate section disposed between two opposing end sections, the heel cushion including a depression that is configured to receive a first end section of the two opposing end sections of the shank and mechanically engage with the first end section, wherein each of the two opposing end sections of the shank has a greater width than the intermediate section of the shank; and a midsole body at least partially surrounding the heel cushion and the shank;

wherein the midsole body has a greater hardness than the heel cushion;

wherein the midsole body includes an opening positioned on at least one of a lateral side and a medial side of the footwear sole and extending inward to the heel cushion;

wherein the shank includes a plurality of connectors that are positioned at the first end section, extend downward from the first end section, and are configured to snap-fit with a plurality of holes in the heel cushion to form a snap-fit interface;

wherein the plurality of holes continuously extend through the heel cushion from an upper side of the heel cushion to a lower side of the heel cushion;

wherein the plurality of holes each include:

an upper opening on an upper side of the heel cushion; and a lower opening on a lower side of the heel cushion;

wherein the plurality of connectors each include:

a shaft that extends from a base of the shank; and a head with a circular periphery that has a greater diameter than a diameter of an associated hole included in the plurality of holes in the heel cushion;

wherein the snap-fit interface is positioned in front of a midline of the heel cushion;

wherein the first end section of the two opposing end sections is positioned longitudinally between the midline of the heel cushion and a front side of the heel cushion;

wherein the first end section is positioned above the heel cushion; and wherein the shank is positioned below an upper.

7. The footwear sole of claim 6, wherein the first end section of the shank is positioned in front of the midline of the heel cushion.

8. The footwear sole of claim 6, wherein the plurality of connectors each extend from a lower side of the heel cushion to an upper side of the heel cushion.

9. The footwear sole of claim 6, wherein the heel cushion is constructed out of an air injected polyurethane (PU), the midsole body is constructed out of a different PU than the heel cushion, and the midsole body is directly coupled to the heel cushion.

10. The footwear sole of claim 6, wherein the midsole body is directly coupled to the shank.

11. The footwear sole of claim 6, wherein a support extension vertically extends across the opening of the midsole body.

12. The footwear sole of claim 6, wherein the plurality of holes are positioned in one or more recesses in the heel cushion.

13. The footwear sole of claim 6, wherein the shank includes a plurality of tangs at a front one of the two opposing end sections, the plurality of tangs being at least partially surrounded by the midsole body.

14. A footwear sole assembly, comprising:

a heel cushion and a shank, the shank including an intermediate section disposed between two opposing end sections, the heel cushion including a depression that is configured to receive a first end section of the two opposing end sections of the shank, wherein each of the two opposing end sections of the shank has a greater width than the intermediate section of the shank; and a midsole body at least partially surrounding the heel cushion and the shank;

wherein the shank includes a plurality of connectors that extend downward from the first end section;

wherein the plurality of connectors are configured to snap-fit into a plurality of holes in the heel cushion to form a snap-fit interface;

wherein the plurality of holes continuously extend vertically through the heel cushion from an upper side of the heel cushion to a lower side of the heel cushion;

wherein the snap-fit interface is positioned in front of a midline of the heel cushion;

wherein the first end section of the two opposing end sections is positioned adjacent to the midline of the heel cushion;

wherein the midsole body has a greater hardness than the heel cushion;

wherein the midsole body includes a plurality of openings positioned on a lateral side and a medial side of the footwear sole assembly;

wherein the plurality of openings each extend inward toward the heel cushion;

wherein the plurality of connectors each include:

a shaft that extends from a base of the shank; and a head with a circular periphery that has a greater diameter than a diameter of an associated hole included in the plurality of holes in the heel cushion;

wherein the first end section is positioned above the heel cushion;

wherein a portion of the intermediate section of the shank is positioned directly vertically above the heel cushion; and wherein the shank is positioned below an upper.

15. The footwear sole assembly of claim 14, wherein the plurality of connectors are positioned in flared sections at opposing sides of the shank.

16. The footwear sole assembly of claim 14, wherein:

the shank includes a plurality of tangs at a front one of the two opposing end sections, the plurality of tangs being at least partially surrounded by the midsole body; and the shank includes undulating ribbing that at least partially extends along a length of the shank.

* * * * *